US010465637B2

(12) United States Patent
Beyer et al.

(10) Patent No.: US 10,465,637 B2
(45) Date of Patent: Nov. 5, 2019

(54) METHOD TO ENHANCE GAS RECIRCULATION IN TURBOCHARGED DIESEL ENGINES

(71) Applicant: Bendix Commercial Vehicle Systems LLC, Elyria, OH (US)

(72) Inventors: Richard Beyer, Westlake, OH (US); Nicholas Asmis, Seven Hills, OH (US); Mark McCollough, Amherst, OH (US); Cory Hamilton, Elyria, OH (US); William Schaffeld, Brecksville, OH (US)

(73) Assignee: Bendix Commercial Vehicle Systems, LLC, Elyria, OH (US)

( * ) Notice: Subject to any disclaimer, the term of this patent is extended or adjusted under 35 U.S.C. 154(b) by 1372 days.

(21) Appl. No.: 13/781,401

(22) Filed: Feb. 28, 2013

(65) Prior Publication Data

US 2014/0238364 A1 Aug. 28, 2014

(51) Int. Cl.

| | |
|---|---|
| ***F02M 35/10*** | (2006.01) |
| ***F02M 26/05*** | (2016.01) |
| ***F02M 26/19*** | (2016.01) |

(52) U.S. Cl.

CPC ..... *F02M 35/10222* (2013.01); *F02M 26/05* (2016.02); *F02M 26/19* (2016.02)

(58) Field of Classification Search

None

See application file for complete search history.

(56) References Cited

U.S. PATENT DOCUMENTS 5,974,802 A * 11/1999 Blake ..... 60/605.2
6,209,530 B1 4/2001 Faletti et al.
6,247,460 B1 6/2001 Linberg et al.
(Continued)

FOREIGN PATENT DOCUMENTS

CN 101187348 A 5/2008

OTHER PUBLICATIONS

International Search Report (PCT/ISA/220 and PCT/ISA/210) dated Jun. 13, 2014 (three pages).
(Continued)

*Primary Examiner* — Xiao En Mo
(74) *Attorney, Agent, or Firm* — Crowell & Moring LLP

(57) ABSTRACT

An apparatus for improving exhaust gas recirculation performance is provided which induces improved exhaust gas recirculation flow during engine operating transients, including transients in which exhaust gas flow conditions are unfavorable. The apparatus includes a fresh air intake passage with a venturi section and an exhaust gas recirculation passage outlet, preferably in the form of a pitot tube, arranged in the fresh air intake passage adjacent to the venturi section such that a pressure-reducing flow in the fresh air is induced as a result of the Coandă effect. Establishing Coandă flow adjacent to the exhaust gas recirculation outlet substantially assists in drawing exhaust gas into the fresh air intake flow in transient operating conditions, including unfavorable exhaust-to-intake pressure difference conditions. The Coandă flow also assists in more rapid and thorough mixing the gases to provide a homogeneous mixture to minimize NOx production during engine operating transients.

8 Claims, 6 Drawing Sheets

(56) References Cited

U.S. PATENT DOCUMENTS

| | | | | |
|---|---|---|---|---|
| 6,748,741 | B2 | 6/2004 | Martin et al. | |
| 6,810,850 | B2 | 11/2004 | Anderson et al. | |
| 6,886,544 | B1 * | 5/2005 | Bui | 123/568.18 |
| 7,131,271 | B2 | 11/2006 | Bulicz et al. | |
| 7,353,811 | B2 * | 4/2008 | Weisz | 123/568.17 |
| 7,426,923 | B2 * | 9/2008 | Berggren | 123/568.18 |
| 7,552,722 | B1 * | 6/2009 | Shieh et al. | 123/568.17 |
| 7,717,099 | B2 | 5/2010 | Nagae et al. | |
| 7,946,117 | B2 | 5/2011 | Atkinson et al. | |
| 8,046,989 | B2 | 11/2011 | VanderGriend et al. | |
| 2006/0124116 | A1 * | 6/2006 | Bui | 123/568.18 |
| 2007/0199549 | A1 | 8/2007 | Weisz | |
| 2009/0139229 | A1 | 6/2009 | Frantzheld et al. | |
| 2010/0146965 | A1 | 6/2010 | Easley, Jr. et al. | |
| 2011/0036088 | A1 | 2/2011 | Xin et al. | |
| 2011/0120432 | A1 | 5/2011 | Ulrey et al. | |

OTHER PUBLICATIONS

Written Opinion (PCT/ISA/237) dated Jun. 13, 2014 (five pages).
Chinese-language Office Action issued in counterpart Chinese Application No. 201480011056.5 dated Mar. 20, 2017 (seven (7) pages).
Chinese-language Office Action issued in counterpart Chinese Application No. 201480011056.5 dated Dec. 14, 2017 with English translation (eight (8) pages).
Chinese-language Office Action issued in counterpart Chinese Application No. 201480011056.5 dated Jun. 27, 2018 with English translation (seven (7) pages).

* cited by examiner

METHOD TO ENHANCE GAS RECIRCULATION IN TURBOCHARGED DIESEL ENGINES

The present invention relates to an apparatus for improving exhaust gas recirculation performance. In particular, the present invention relates to an apparatus for inducing exhaust gas recirculation flow into an intake manifold of an engine such as a turbocharged diesel engine to provide improved recirculated exhaust gas mixing and more consistent recirculated exhaust gas flow during engine operating transients.

BACKGROUND OF THE INVENTION

In the field of vehicle emissions controls, it is well known that during certain operating states of the engine undesired combustion products such as oxides of nitrogen ("$NO_x$") may be minimized by introducing a portion of the exhaust gases leaving the engine's combustion chambers back into the engine's intake manifold. The recirculated exhaust gas dilutes the incoming fresh intake air, resulting in a mixture to the engine that provides two primary mechanisms for reducing NOx formation. The first mechanism is the mixture reducing the peak in-cylinder combustion temperatures where the exhaust gas acts as a heat sink. The second mechanism is the dilution of the fresh air stream, displacing some of the oxygen which would have otherwise been drawn into the combustion chamber. The lower oxygen content results in fewer constituent oxygen atoms that feed the creation of NOx and results in an overall reduction of NOx formation.

In conventional internal combustion engines, such as for example the engine 1 shown schematically in FIG. 1, an exhaust gas recirculation passage 2 is provided between an exhaust line 10 leading away from the engine's combustion chambers 3 to the engine's intake manifold 20. The exhaust gas recirculation line is often provided with a cooler 22 for cooling the portion of exhaust gas being recirculated into the intake manifold, and a flow control valve 23. The flow control valve 23 may be opened, closed and/or throttled to control the amount of exhaust gas being recirculated and thereby better match the engine's recirculated exhaust gas need to the current engine operating state. If the engine is equipped with a turbocharger 30, the exhaust gas recirculation passage 2 is typically provided downstream of the turbocharger's compressor section 31, intercooler 40 and/or any intake flow control device 50, and upstream of the turbocharger's turbine 32 and exhaust gas treatment devices 60.

A well known problem with exhaust gas recirculation systems is the tendency for recirculating exhaust gas flow from the exhaust to the intake manifold to decrease or even halt during certain engine operating conditions, i.e., when there exists an unfavorable pressure ratio between the exhaust and the intake lines, or low exhaust mass flow rate conditions are present. For example, in response to a sudden increase in engine power output demand, there may be too little exhaust gas flow available in the exhaust to supply the intake manifold with sufficient recirculated exhaust gas to match the sudden increase in oxygen and fuel being supplied to the engine's cylinders. In such situations, the lack of sufficient recirculated exhaust gas may result in an inability to adequately suppress $NO_x$ formation during the transient condition, and a corresponding potential to exceed $NO_x$ emissions requirements.

An additional problem some recirculating exhaust gas systems can experience is with the use of a turbocharger, in that the turbocharger may develop sufficient pressure in the intake manifold to effectively halt the flow of exhaust gas through the exhaust gas recirculation line to the intake, particularly during engine output demand transients.

Previous attempts to improve exhaust gas recirculation flow primarily have concentrated on building backpressure in the downstream exhaust piping, such as by at least partially closing a downstream exhaust brake valve located upstream or downstream of the turbine side of a turbocharger, or by using a costly variable geometry turbocharger whose vanes may be adjusted to reduce flow through the turbocharger and thus build backpressure. Such approaches increase the pressure differential across the exhaust gas recirculation line between the exhaust line and the intake manifold. However, even with the assistance of such exhaust line components, adequate exhaust gas recirculation flow to the intake manifold cannot be assured in many transient engine operating conditions.

In view of these and other problems in the prior art, it is an objective of the present invention to provide enhanced exhaust gas recirculation flow in all operating engine conditions, including in particular transient engine operating conditions. It is a further objective to provide improved mixing of recirculated exhaust gas and fresh air in these operating conditions.

These and other objectives are addressed by a novel arrangement of a venturi and pitot tube nozzle components which establishes conditions in which the Coandă effect may be employed to enhance exhaust gas recirculation flow under virtually any engine operating condition. These arrangements thereby help minimize the potential for exceeding emissions limitations during engine operating conditions, including transient conditions.

The Coandă effect is a phenomenon in which a fluid jet, such as a gas jet, flowing in the same type of fluid (e.g., a gas jet flowing in a gas, or a liquid jet flowing in a liquid) is deflected as it passes an adjacent convex surface, following the contour of the convex surface until the fluid jet flow separates from the surface. In effect, the high-velocity jet conforms to the convex surface because the fluid in which the high-velocity jet is flowing is not present between the high-velocity jet and the adjacent convex surface, i.e., the high-velocity jet's deflection "fills" the vacuum which would otherwise be created between the high-velocity jet and the adjacent convex surface. The deflection toward the convex surface is accompanied by a drop in pressure and an increase in fluid velocity in the vicinity of the adjacent surface, in accordance with Bernoulli's fluid flow equations.

The decrease in fluid pressure resulting from the Coandă effect may be used to augment a pressure differential and/or to increase a mass flow rate in another fluid. For example, in aircraft applications a wing's lift may be increased by discharging the exhaust gases from a jet engine over the top surface of a wing so that high velocity exhaust gas jet flow deflected along the convex wing upper surface experiences a decrease in pressure, effectively increasing the pressure differential between the lower and upper surfaces of a wing. In other applications, the decreased pressure and increased velocity in the high-velocity jet at the point at which it must follow an adjacent convex surface may be used to enhance the mass flow rate of an adjacent fluid stream by: (i) increasing the differential pressure between an upstream point at which the adjacent flow stream enters the flow channel and the point where the Coandă effect is being generated, and (ii) increasing the lateral dispersion of the adjacent fluid into the high-velocity fluid by physical entrainment in the high Coandă flow region. This high velocity entrainment also helps promote more thorough mixing of the fluid streams.

In an embodiment of the present invention, an exhaust gas recirculation line having the general shape of a pitot tube is located with an opening of the pitot tube axially aligned with the center of an outer tube of a venturi manifold though which relatively high pressure fresh air flows. Preferably, the outlet of the pitot tube is facing in the downstream flow direction and is axially located in the vicinity of an entrance of a necked-down region of the outer tube. The transition between a decreasing-diameter region of the outer tube and a necked-down, relatively-straight region of the outer tube provides a convex wall surface on the inside of the outer tube. As the fresh air flowing in this area conforms to the convex surface, the Coandă effect results in decreased pressure and increased velocity in the fresh air. Further, by locating the outlet of the pitot tube at the outer tube center line in the transition region between the widest and narrowest regions of the outer tube (i.e., in the converging flow region), the outer surface of the pitot tube effectively reduces the cross-sectional flow area for the fresh air in the outer tube, thereby further increasing the fresh air velocity and lowering the fresh air pressure for a given fresh air mass flow rate.

The relationships between the parameters of the present invention's flow enhancement may be varied as needed for the application, as long as suitable flow performance is maintained. For example, in the prior art the "velocity ratio" between the velocity of the recirculating exhaust gas being injected and the fresh intake air upstream of the exhaust gas injection point had typically been on the order of approximately 1.5. With the enhancement associated with the application of the Coandă effect in the present invention, velocity ratios of approximately 2.0 to 5.0 result, allowing better mixing efficiency, increased exhaust gas flow and prevention of back flow in the exhaust gas conduit.

The parameters affecting the velocity ratio include inner diameter $D_1$ of the fresh air tube upstream of the recirculating exhaust gas injection point, the inner diameter $D_2$ of the narrowed portion of the tube, the angle of convergence a of the converging portion of the tube ($D_1$, $D_2$ and a thereby defining the length l of the converging portion), the depth of insertion x and the outer diameter $d_1$ of the exhaust gas injection conduit into the converging portion of the tube, and the mass flow rate of the recirculating exhaust gas $m_1$ and the fresh air $m_2$. Taken together, these variables define annular area A between the injection end of the recirculating exhaust gas conduit and the laterally adjacent converging tube wall (i.e., $A=f(D_1, D_2, d_1, x, a)$, and the resulting velocity ratio VR (i.e., $VR=f(D_1, D_2, d_1, x, a, m_1, m_2)$).

With this arrangement of the exhaust gas recirculation pitot tube and the converging fresh air outer tube, the significantly reduced pressure in the vicinity of the outlet of the pitot tube presents a substantially enhanced pressure differential between the exhaust gas line and fresh air outer tube. This increased pressure difference serves to significantly increase the mass flow rate and velocity of the exhaust gas extracted from the pitot tube outlet, even during certain engine operating conditions in which the pressure ratio between the exhaust and intake manifolds is typically unfavorable.

A further benefit of the use of the Coandă effect is to enhance the lateral migration of the exhaust gas extracted from the pitot tube, where the decrease in pressure in the fresh air as it flows long the convex outer wall surface effectively draws the exhaust gas laterally toward the tube wall. This effect provides a much greater homogeneity in the recirculated exhaust gas fresh air mixture flowing toward the combustion chambers, and a corresponding cross-sectional velocity profile in the outer tube in which the typical "V" distribution from the center outward is flattened. The enhanced mixing also occurs in a much shorter distance than in conventional exhaust gas recirculation systems which simply discharge exhaust gas directly into the engine fresh air intake line. The lateral mixing of the exhaust gas with fresh air may be further enhanced by providing a divergent outer tube region downstream of the outer tube convergent flow region.

The improved homogeneity of the fresh air/recirculated exhaust gas mixture entering the engine's combustion chambers further enhances control of $NO_x$ formation in the combustion chamber by substantially reducing localized regions of over- and under-supply of recirculated exhaust gas in the combustion chamber.

Previous systems using a pitot tube to inject exhaust gas into the fresh air charge tube used a straight pitot tube in a manner which primarily only provided an exhaust gas entry point in the fresh air flow at or near a venturi section, resulting in the exhaust gas being swept along in a relatively homogeneous flow inside the fresh air column for a substantial downstream distance. Accordingly, in order to try to avoid an inhomogeneous air/exhaust gas mixture entering the engine cylinders (potentially increasing $NO_x$ emissions), previous designs required an undesirably long intake tract downstream of the exhaust gas injection point in order to provide sufficient gas mixing. Such long intakes are difficult for designers to accommodate in the highly space-constrained engine compartments of modern vehicles.

In order to address the lack of homogeneous mixture in the above-described previous design, it has been known to provide multiple small exhaust gas inlet tubes clustered in the fresh air charge tube to provide enhanced mixing at a shorter distance from the exhaust gas injection point. However, these designs suffer from the disadvantage of not providing a pressure gradient sufficiently high to ensure adequate exhaust gas recirculation flow in all engine operating conditions.

In contrast to these previous designs, the arrangement of the venturi and pitot tube to generate a Coandă effect-driven enhancement of exhaust gas extraction from the pitot tube outlet results in significantly greater homogeneity in the mixed fresh air/exhaust gas flow, and achieves a higher level of this homogeneity in a considerably shorter distance. This higher performance allows the designer much greater flexibility in engine systems layout, as excessively long downstream intake passages are no longer required to ensure a sufficiently well mixed charge arrives in the engine cylinders.

Variations on the above embodiment to achieve equivalent functional arrangements are possible. For example, rather than providing an outer tube which has to be contoured to achieve the converging, convex and diverging regions, an appropriately-shaped tubular insert may be placed inside a constant-section outer tube.

Other objects, advantages and novel features of the present invention will become apparent from the following detailed description of the invention when considered in conjunction with the accompanying drawings.

DETAILED DESCRIPTION

Figure 1:
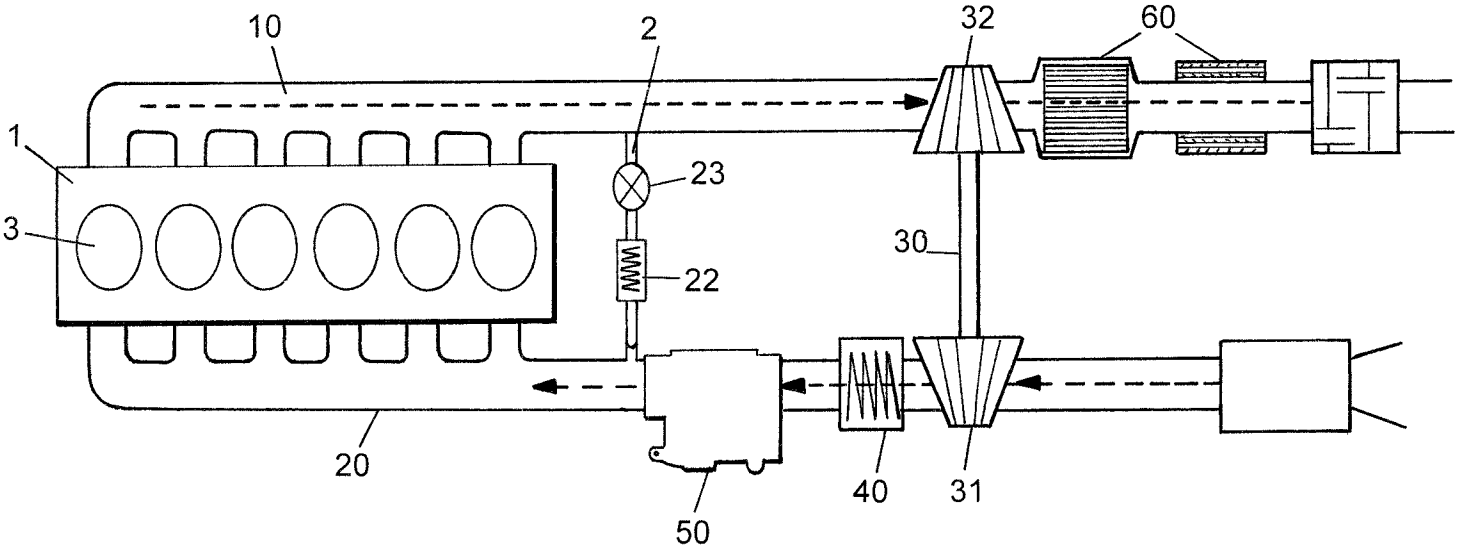
FIG. 1 is a schematic illustration of a previously known turbocharged engine an exhaust gas recirculation passage.
Figure 2A:
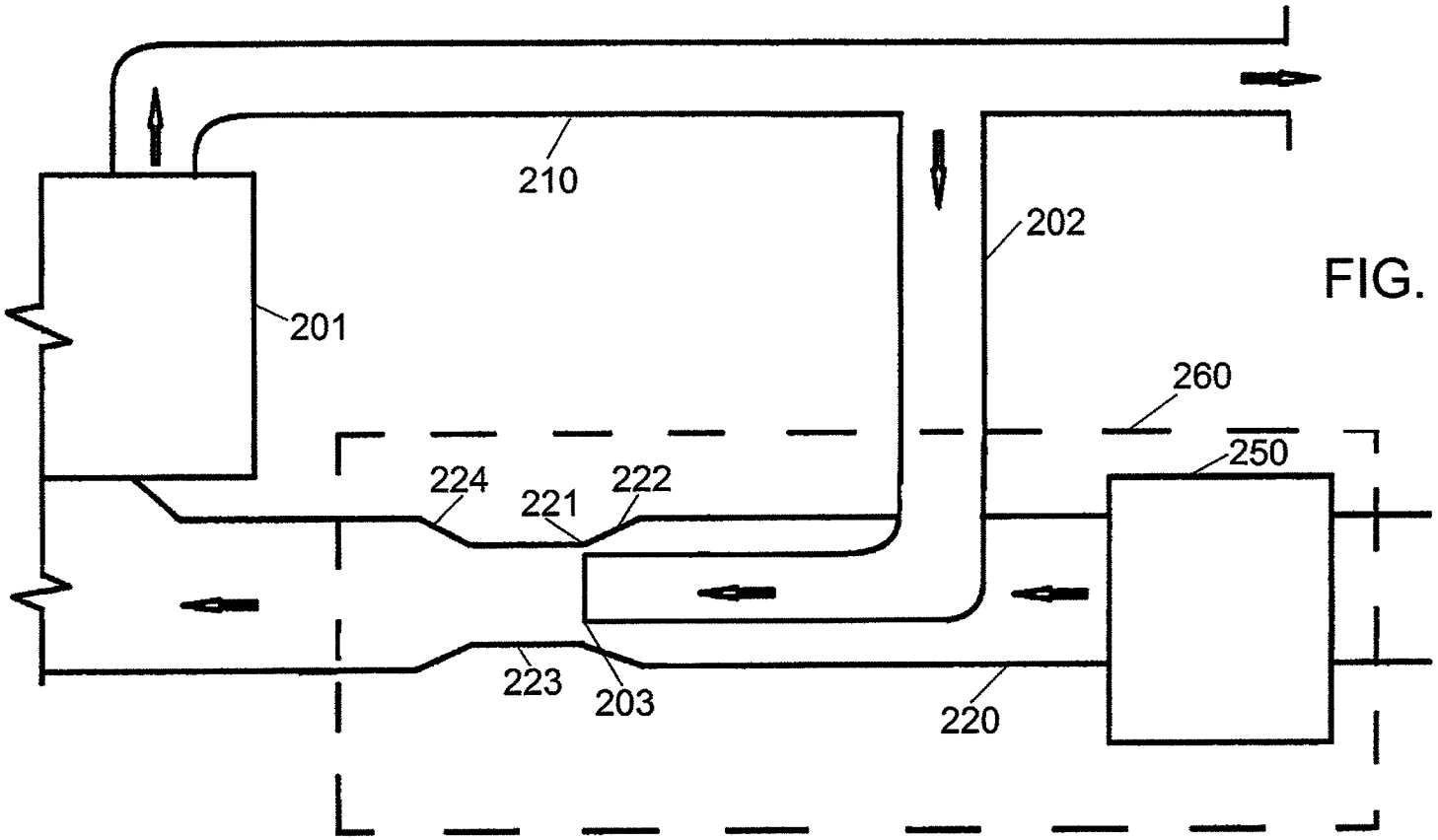
FIG. 2*a* is a schematic illustration of an exhaust gas recirculation system arrangement in accordance with an embodiment of the present invention.
Figure 2B:
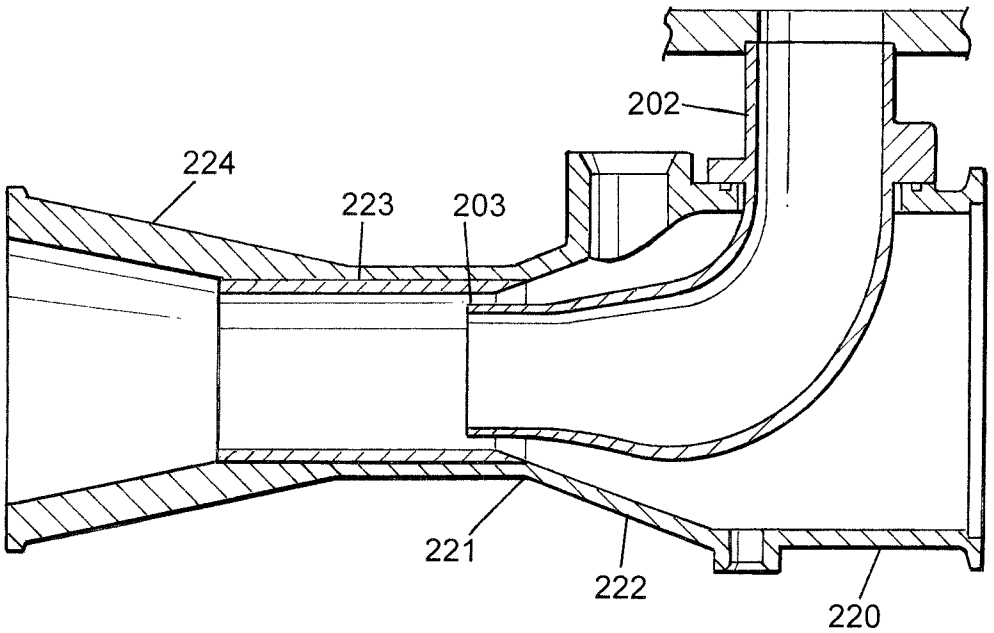
FIG. 2*b* is a schematic illustration of an exhaust gas recirculation system arrangement in accordance with an embodiment of the present invention.

FIG. 2*a* is a simplified schematic cross-sectional illustration of an embodiment of the present invention. FIG. 2*b* is a cross-section of an example embodiment focusing on the region of the pitot tube and venturi in FIG. 2*a*. As shown in FIG. 2*a*, exhaust gas which is to be recirculated is conducted from exhaust manifold 210 to the fresh air intake 220 via a conduit 202 which penetrates the fresh air intake 220 and ends at an outlet end 203, approximately centered in the fresh air intake 220 and facing in a downstream flow direction toward engine 201. The outlet 203 of the exhaust gas recirculation conduit 202 has a generally pitot tube-shape, preferably with an outer wall which thins to a tapered edge, so as to minimize flow disturbances at the point the exhaust gas leaves the conduit.

The outlet 203 is positioned directly in the vicinity of the narrowest portion 221 of a converging portion 222 of the fresh air intake 220. The converging portion 222 is followed by an approximately parallel-walled, constant cross-section portion 223 (also referred to as the "throat"), which in turn is followed by a diverging portion 224. This generally venturi-shaped portion of the fresh air intake 220, combined with the careful location of the pitot tube-shaped outlet 203 directly adjacent to the narrowest portion 221 of the converging section 222. In an example embodiment, the venturi throat may have a diameter of 44.5 mm, the pitot tube may have an outer diameter of 38.1 mm, and the venturi is located at distance of 2.4 mm from the throat to obtain Coandă-driven enhancement of the exhaust gas flow from the pitot tube outlet 223.

As the flow of fresh air in fresh air intake 220 passing through intake flow control device 250 encounters the portion of the exhaust gas recirculation conduit 202 within the fresh air intake 220, the flow of fresh air accelerates to a higher velocity as this portion of the conduit 202 effectively reduces the available cross-sectional flow area within the fresh air intake 220 (as one of ordinary skill will recognize, the decrease in flow area requires a proportionate increase in flow velocity in order to maintain the mass flow rate of the incoming fresh air). The increase in fresh air velocity is accompanied by a commensurate decrease in pressure in the fresh air, per Bernoulli's well-known flow equations. As the fresh air passes further down the intake 220 into the converging portion 222, velocity is further increased and pressure is decreased due to the decrease in cross-sectional flow area. The amount of reduction in cross-section preferably is optimized for each engine application, preferably such that the length of the converging portion and the diameter of the intake 220 at the narrowest portion 221 together provide the greatest acceleration of the fresh air without creating a choke point which undesirably raises back-pressure in the intake tube.

As the now-faster-moving fresh air flow near the inner wall of the intake 220 passes the narrowest part of the converging portion 222, the flow is presented with a convex-shaped wall surface as it passes from upstream to downstream of narrowest portion 221. As the fresh air flow passes in the region of the convex wall, in the absence of another fluid between the fresh air and the convex wall, the Coandă effect causes the fresh air flow to be deflected toward the walls of the narrow constant cross-section portion 223, further reducing the pressure in the fresh air flow (and thereby increasing the fresh air flow velocity) as the fresh air flow must expand from its flow stream toward the downstream portion of the convex wall surface.

The cumulative effect of these several fresh air flow velocity increases and pressure decreases is to present a particularly low pressure area in the region at, and immediately downstream of, the outlet 203 of the pitot tube-shaped end of exhaust gas recirculation conduit 202. This localized low pressure region acts to greatly assist in the extraction of recirculating exhaust gas flow from the conduit by increasing the pressure differential between the exhaust manifold 210 and the fresh air manifold 220. The relatively high pressure difference between these manifolds caused by the local pressure decrease at outlet 203 maintains the strong positive flow of recirculated exhaust gas in virtually all engine operating conditions of interest, even conditions which previously might have resulted in low or no recirculation of exhaust gas and exceeding emissions limits.

In addition to helping aid extraction of recirculated exhaust gas from the exhaust gas recirculation conduit 202, the location of the outlet 203 at or directly upstream of the convex wall portion of the converging portion 222 to take advantage of the Coandă effect enhances the lateral migration of the exhaust gas extracted from the pitot tube. The Coandă effect, which draws the fresh air toward the wall of the passage and thereby creates a lower pressure area at the inner annulus of the fresh air passing by outlet 203, effectively draws the exhaust gas emerging from the outlet 203 laterally toward the tube wall. This radially-outward-drawing of the exhaust gas provides greater mixing and homogeneity in the exhaust gas/fresh air mixture flowing toward the combustion chambers, and does so in a much shorter distance than in conventional exhaust gas recirculation systems which simply discharge exhaust gas directly into the engine fresh air intake line. This effect may be further enhanced by providing a divergent outer tube region downstream of the outer tube convergent flow region, the lateral mixing of the exhaust gas with fresh air is further enhanced.

Figure 3:
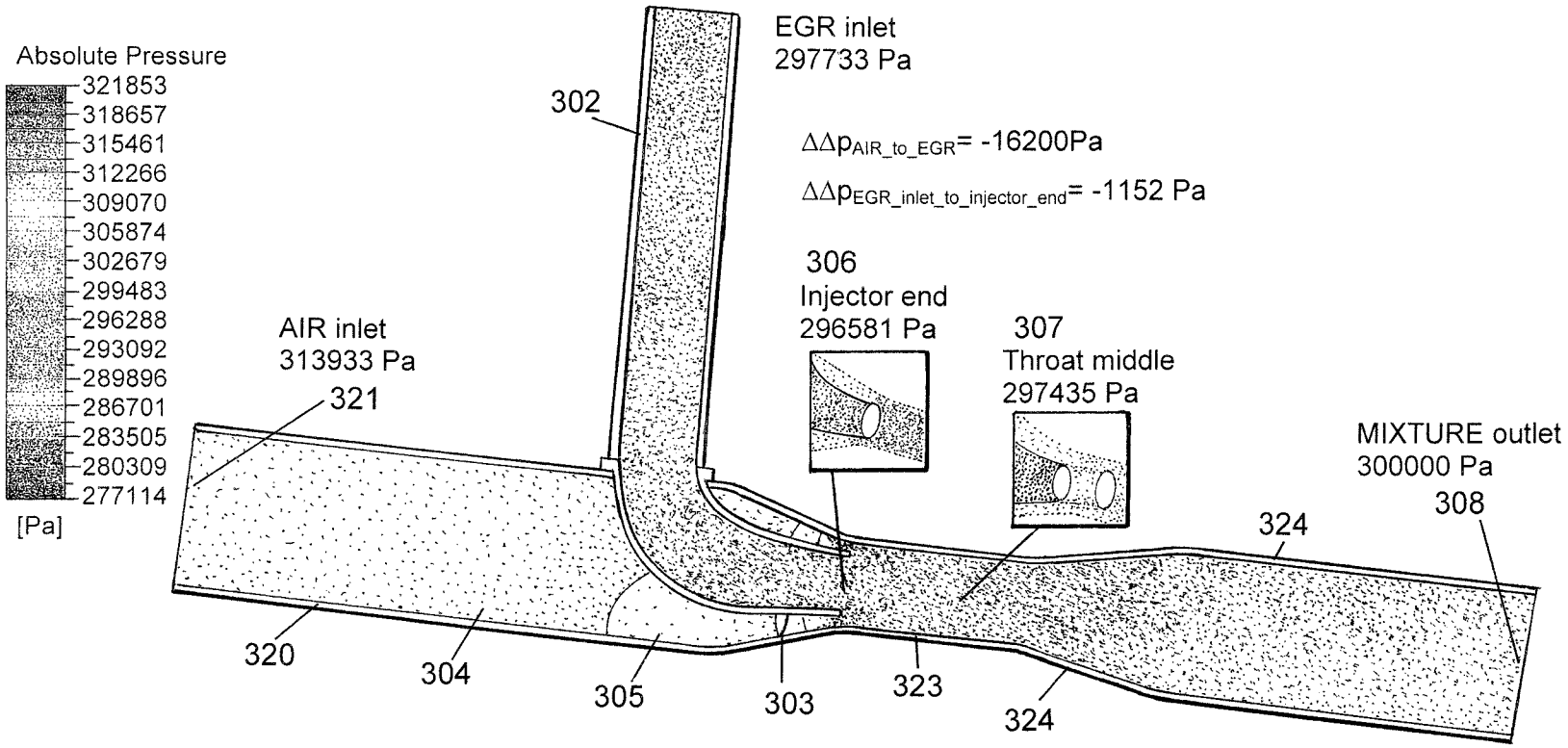
FIG. 3 is an illustration of an example pressure distribution in an exhaust gas recirculation system arrangement similar to that illustrated in FIG. 2.

FIG. 3 illustrates an example pressure distribution in an EGR inlet arrangement similar to that in FIG. 2. In this arrangement, a fresh air inlet tube 320 is penetrated by an exhaust gas recirculation conduit 302, which turns and reaches a tapered outlet 303 facing downstream in the fresh air inlet tube 320. Immediately downstream of the EGR outlet 303 the fresh air tube 320 necks down to a minimum diameter in narrowed portion 323, followed by a tapered expansion to a larger inner diameter portion 324 of fresh air inlet tube 320.

Illustrated in the FIG. 3 arrangement is an engine operating condition in which the exhaust gas pressure at the inlet 304 of the exhaust gas recirculation conduit 302 is 297733 Pascal, while the fresh air pressure and inlet 321 of the fresh air inlet tube 320 is 313933 Pa. Under these conditions, in the absence of the EGR arrangements of the present invention, exhaust gas recirculation would not be possible due to the unfavorable pressure ratio between the intake and exhaust manifolds (the pressure in the fresh air inlet tube 320 being 16200 Pa higher than at the inlet to EGR conduit 302).

However, by use of the present invention the extraction of recirculated exhaust gas into the fresh air intake is assured, due to the pressure reductions in the fresh air flow caused by the venturi and Coandă effects. In this example, the pressure seen by the exhaust gas at the tip of the EGR conduit 302 (i.e., at outlet 303) is 296581 Pa, or 1152 Pa lower than the pressure at EGR recirculation conduit inlet 304. This pressure differential provides for reliable extraction of recirculated exhaust gas from the EGR recirculation conduit 302, despite the greater pressure in the fresh air inlet tube 320. Moreover, as the fresh air encounters the portion of the EGR conduit 302 within the fresh air inlet tube 320, the reduction in flow cross-sectional area also reduces the pressure of the fresh air, such that it can support the maintenance of the desired low pressure at the EGR conduit outlet 303. This pressure reduction in response to the fresh air velocity increase may be observed in the FIG. 3 example in zones 304, 305, 306 and 307, where the pressure drops from 313933 Pa through 315461 Pa (zone 304), 312266 Pa (zone 305), 309070 Pa (zone 306) and 297435 Pa (zone 307), respectively. After then passing through diverging portion 324, the increased flow cross-sectional area results in a decrease in flow velocity for a given mass flow rate, and consequent increase in pressure relative to the upstream EGR injection location. In this example, by the time the mixed fresh air and recirculated exhaust gases reach intake point 308, the intake pressure has risen to 3000000 Pa.

Figure 4B:
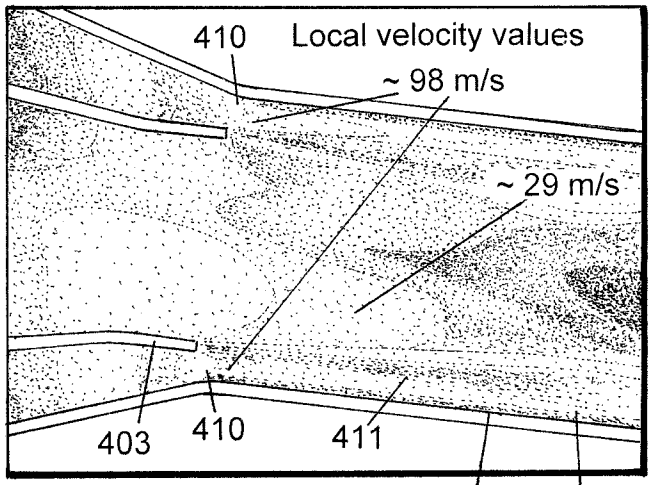
FIGS. 4*a*-4*c* are illustrations of an example gas velocity distribution in the exhaust gas recirculation system arrangement of FIG. 3.
Figure 4C:
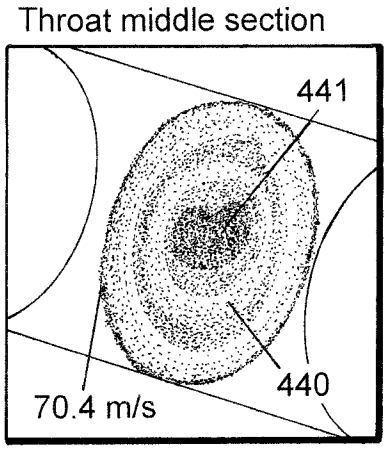
Figure 4A:
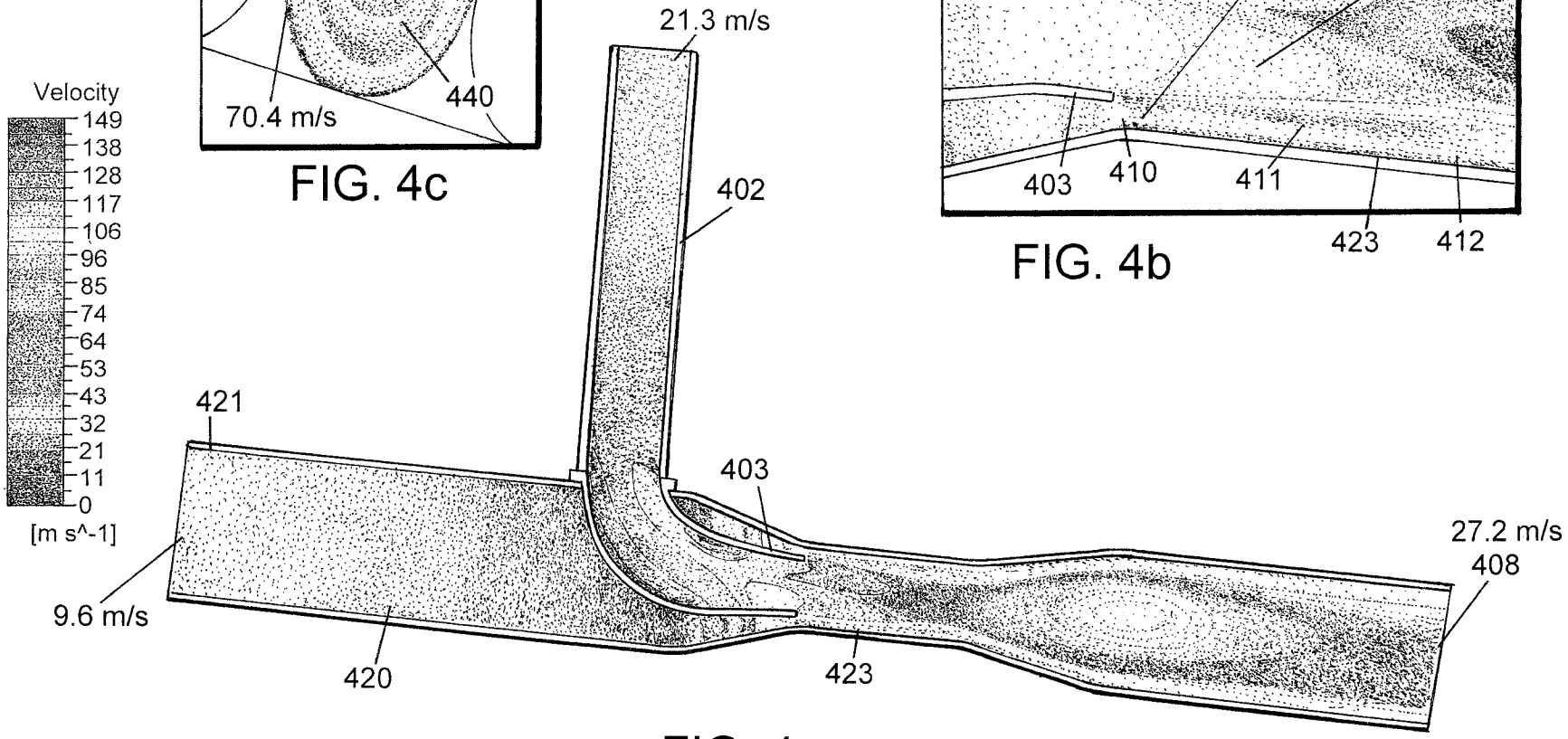

FIGS. 4*a*-4*c* are an illustration of the velocity distribution of the fresh air and recirculated exhaust gases in the exhaust gas recirculation system arrangement of FIG. 2 corresponding to the pressure distributions illustrated in FIG. 3. FIG. 4*a* shows the arrangements of FIG. 3 with cross-section average velocities at the fresh air inlet 421, the inlet of EGR conduit 402 and at intake point 408 being 9.6 meters/second, 21.3 m/s and 27.2 m/s, respectively. As shown in FIG. 4*a* (and in greater detail in FIG. 4*b*), as the fresh air flow encounters the EGR conduit the velocity profile in the fresh air increases around the pitot tube-shaped EGR outlet, reaching on the order of 100 m/s at the gap between EGR outlet 403 the entry of reduced inner diameter portion 423. Immediately downstream of the recirculated exhaust gas injection point (outlet 403), the localized decrease in pressure at the outlet has led to acceleration of the exhaust gas flow to 29 m/s in the low pressure region between the fresh air flows along the walls of the narrowed portion 423. The enhanced pressure decrease and velocity increase in this region is enhanced by the Coandă effect, which may be observed in FIG. 4*b* where the fresh air flow 410 near the convex wall surface near the EGR outlet 403 is turned to follow the wall surface in portion 423, effectively increasing the available cross-sectional area into which the recirculated exhaust gas may flow. Thus, the recirculated exhaust gas is given an additional outward radial momentum, such that it more rapidly expands towards the fresh air flow 410 which has been bent toward the tube wall and begins to mix with the fresh air. This may be observed at point 411 where, only a few millimeters downstream from the exhaust gas injection point 403, the local velocity of the flow has decreased to approximately 80 m/s (indicating substantial mixing of the high velocity fresh air and lower velocity exhaust gas has already begun). The relatively "flat" velocity profile across the narrowed portion 423 may be observed in FIG. 4*c*, which shows a velocity difference of only about 15 m/s between the center 441 of the cross section and a radial point 440 representing approximately 75% of the flow area (in this example, a difference between approximately 20-35 m/s).

By the end of the narrowest flow section (point 412), the flow velocity just inside the wall is on the order of 50 m/s, while the velocity in the center of the cross-section at point 412 is on the order of 20 m/s, indicating that the fresh air and recirculated exhaust gas is mixed to an even greater extent. By the time the mixed gas flow reaches intake point 408, the velocity distribution is nearly uniform across the flow section, varying from approximately 10 m/s to 30 m/s all of the way across the cross-section of the tube 420. Such a thorough mixing of the recirculated exhaust gas in the fresh intake air helps ensure an essentially homogeneous distribution of recirculated exhaust gas in the air admitted into the engine's combustion chambers, minimizing the potential for "hot spots" during fuel combustion in the chamber and undesired localized high concentrations of $NO_x$.

Figure 5B:
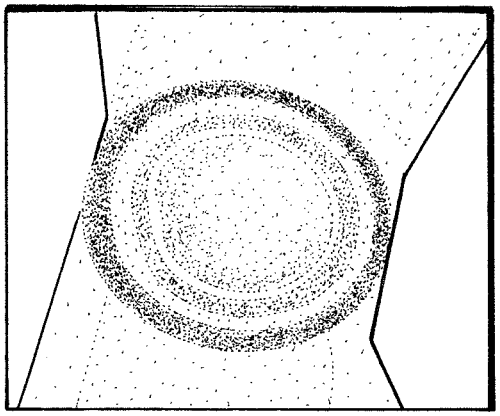
FIGS. 5*a*-5*b* are an illustration of an example distribution of exhaust gas and fresh air mixture as a function of location and distance from the conduit wall in an exhaust gas recirculation system arrangement similar to that illustrated in FIG. 2.
Figure 5A:
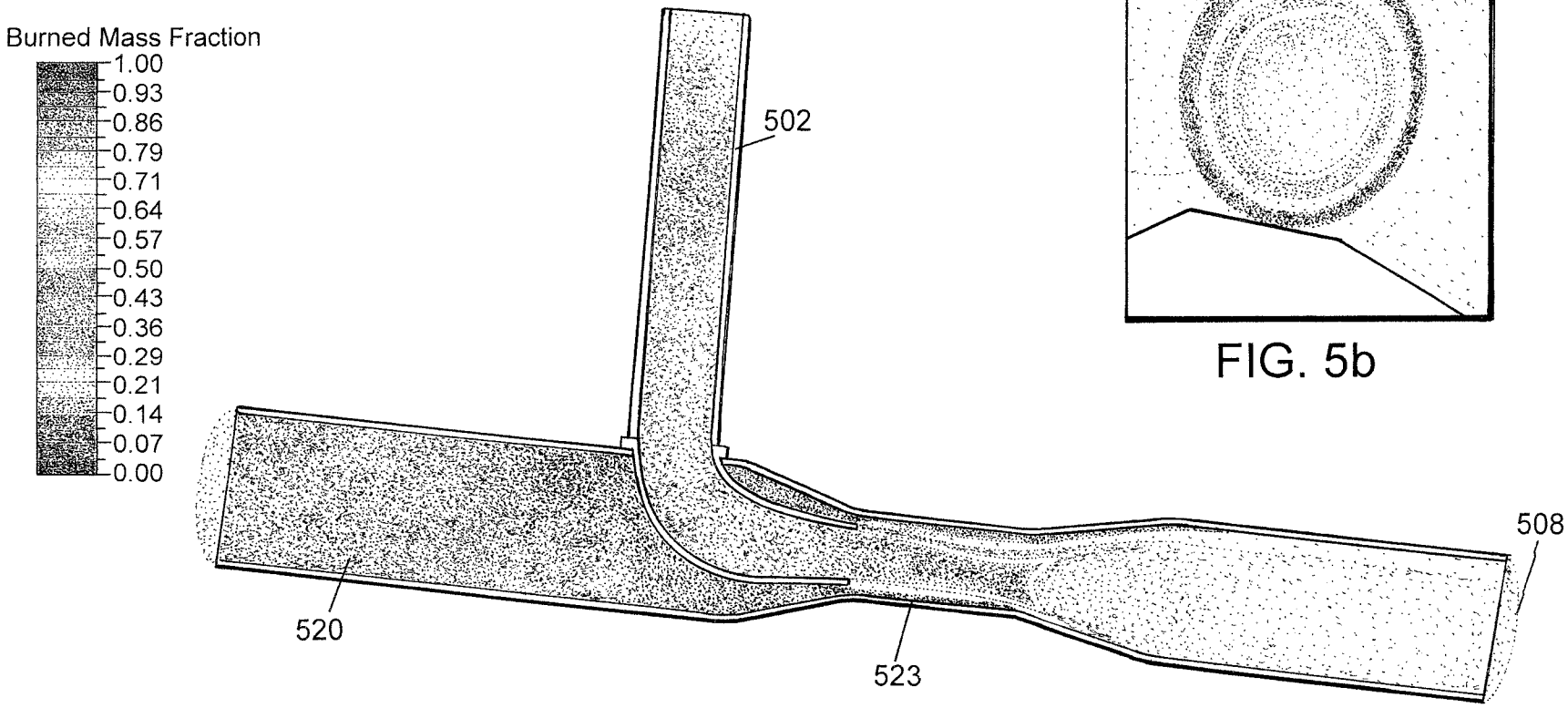

An example of the thorough mixture of gases in a short distance is illustrated in FIGS. 5*a*-5*b*. FIG. 5*a* shows the "burned Mass Fraction" of the gases, i.e., the amount of recirculated exhaust gas at any point within the system with pure recirculating exhaust gas (burned mass fraction=1.0) in EGR conduit 502, and pure fresh intake air (burned mass fraction=0) in tube 520, upstream of the narrowed portion 523. As shown in detail in FIG. 5*b*, at approximately the middle of the narrowed portion 523 the Coandă-enhanced flow has drawn a substantial portion of the central or core flow of recirculated exhaust gas outwards towards the tube walls. In this example, only a short distance downstream from the exhaust gas injection point the portion of the central exhaust gas flow which is still completely exhaust gas (burned mass fraction=1.0) has been reduced to approximately 60% of the diameter of the tube, with more than 40% of the tube width containing varying degrees of mixed exhaust gas and fresh air. As indicated in FIG. 5*a*, by the time the gas flows have reached the end of the diverging portion of the tube, the mixture is nearly completely uniform across the width of the tube as it flows toward outlet 508.

During operation of the internal combustion engine, the exhaust gas recirculation enhancing apparatus may operate in a generally autonomous manner, with the accelerated, decreased pressure fresh air flow serving to help draw exhaust gas from the exhaust gas recirculation conduit even when an unfavorable pressure ratio is present. The exhaust gas recirculation arrangement may be further operated in coordination with additional vehicle components, such as a mechatronic exhaust brake, a variable geometry exhaust turbocharger, a EGR conduit flow control valve and a pressurized air injection boost system (a "PBS" system) to more rapidly and/or more precisely control the rate and timing of recirculated exhaust gas injection into the fresh air stream. For example an electronic control unit ("ECU") assigned to the vehicle engine executes a control program in which a variety of sensor inputs, such as engine torque demand, engine speed, exhaust gas temperature, intake air mass flow rate, pressure and/or temperature, exhaust flow control device position, exhaust gas treatment device operating condition (e.g., needing regeneration), exhaust oxygen content sensor, fresh air intake throttle plate position, etc., are used to define a target exhaust gas recirculation flow rate into the engine fresh air intake manifold, and actuation of the various control devices in the intake and exhaust systems to provide the target amount of recirculated exhaust gas to optimize emissions for the present combustion cycle. The EGR flow then may be iteratively refined via closed-loop monitoring of exhaust emissions (such as by an exhaust oxygen sensor) to maintain the recirculated exhaust gas concentration at a level which minimizes emissions.

With a sufficiently high speed processor, the ECU may be able to preemptively increase EGR flow to respond to an anticipated torque demand increase to more quickly match emissions targets. For example, the system may operate the system actuators to increase exhaust gas flow in response to receiving a sudden increase in driver torque demand signaled through the driver's throttle pedal, rather than waiting for the ECU to see a change in the exhaust oxygen concentration, or operate actuators in anticipation of a torque demand increase based on input from a GPS device signaling an upcoming road gradient.

The foregoing disclosure has been set forth merely to illustrate the invention and is not intended to be limiting. For example, while the foregoing disclosure refers to the exhaust gas recirculation conduit in which the outlet region is formed in a pitot tube-shape, other configurations which are suitable for enhanced exhaust gas extraction from the EGR conduit would be acceptable. A large number of alternative embodiments are also envisioned, both to permit tailoring of the EGR injection arrangements to suit the individual engine and/or vehicle arrangements, and to suit individual vehicle equipment specification, such as the presence or absence of an exhaust gas back pressure-generating valve downstream in the exhaust line to enhance or alter the pressure difference between the exhaust and intake manifolds. For example, a lower flow-restricting venturi/Coandă effect arrangement may be provided in the intake which, while on its own is not sufficient to cover all desired EGR injection flow regimes, nonetheless may be teamed with a mechatronic exhaust brake valve to provide sufficient EGR flow in all operating conditions of concern, thereby minimizing flow restrictions in both the intake and exhaust manifolds while achieving the desired EGR mixing and minimization of exhaust emissions. Configuration alternatives may include integration of the exhaust gas recirculation and venturi section into an integrated fresh air intake module to minimize system packaging space and facilitate easy integration into new engine designs and/or retrofitting of older vehicles with the present invention. Such a module may also include an intake throttle valve and/or a pneumatic boost system ("PBS") compressed air injection apparatus, as schematically indicated by the dashed line in FIG. 2*a* denoting integrated module 260. Because such modifications of the disclosed embodiments incorporating the spirit and substance of the invention may occur to persons skilled in the art, the invention should be construed to include everything within the scope of the appended claims and equivalents thereof.

What is claimed is:

1. An apparatus for exhaust gas recirculation for an internal combustion engine, comprising:

a fresh air intake passage of the engine arranged to direct a majority of fresh air to be introduced into the internal combustion engine to the engine;

a fresh air flow control valve arranged in the fresh air intake passage; and an exhaust gas recirculation conduit arranged to pass exhaust gas from an exhaust manifold of the engine to the fresh air intake passage, wherein the fresh air intake passage includes a reduced cross-section flow portion between the fresh air flow control valve and a combustion chamber of the engine, the exhaust gas recirculation conduit is arranged to introduce exhaust gas from the exhaust manifold into the fresh air intake passage at a location adjacent to an upstream end of the reduced cross-section portion, an outlet of the exhaust gas recirculation conduit is arranged facing downstream within, and within a central region of, the fresh air intake passage, and an outer surface of the outlet of the exhaust gas recirculation conduit and an inner surface of the fresh air intake passage are shaped to generate Coandă flow at the upstream end of the reduced cross-section portion.

2. The apparatus of claim 1, wherein the exhaust gas recirculation conduit is a tube with an outlet end portion arranged parallel to a flow direction of, and concentrically within, the fresh air intake passage.

3. The apparatus of claim 2, wherein the outlet end portion of the exhaust gas recirculation conduit is arranged as a pitot tube with a tapered conduit wall at the outlet.

4. The apparatus of claim 1, wherein the outlet end portion of the exhaust gas recirculation conduit is arranged downstream of an intake air compressor.

5. An integrated exhaust gas recirculation induction module for an internal combustion engine, comprising:

a fresh air intake passage of the engine arranged to direct a majority of fresh air to be introduced into the internal combustion engine to the engine;

a fresh air flow control valve arranged in the fresh air intake passage; and an exhaust gas recirculation conduit arranged to pass exhaust gas from an exhaust manifold of the engine to the fresh air intake passage, wherein the fresh air intake passage includes a reduced cross-section flow portion between the fresh air flow control valve and a combustion chamber of the engine, the exhaust gas recirculation conduit is arranged to introduce exhaust gas from the exhaust manifold into the fresh air intake passage at a location adjacent to an upstream end of the reduced cross-section portion, an outlet of the exhaust gas recirculation conduit is arranged facing downstream within, and within a central region of, the fresh air intake passage, an outer surface of the outlet of the exhaust gas recirculation conduit and an inner surface of the fresh air intake passage are shaped to generate Coandă flow at the upstream end of the reduced cross-section portion, and the outlet end of the exhaust gas recirculation conduit, the reduced cross-sectional flow portion of the fresh air intake passage and the fresh air flow control valve are integrated into a common module.

6. The integrated exhaust gas recirculation induction module of claim 5, further comprising:

at least a portion of pneumatic boost system air injection manifold integrated into the induction module and communicating with the fresh air intake passage.

7. An apparatus for exhaust gas recirculation for an internal combustion engine, comprising:

a fresh air intake passage of the engine having a narrowed portion; and an exhaust gas recirculation conduit arranged to pass exhaust gas from an exhaust manifold of the engine to the fresh air intake passage, wherein a velocity ratio between a velocity of fresh air in the fresh air intake passage upstream of an outlet of the exhaust gas recirculation conduit is in a range of 2 to 5.

8. The apparatus of claim 7, wherein the velocity ratio in the range of 2 to 5 is obtained by adjusting at least one of configuration parameters including an inner diameter of the fresh air intake passage upstream of the exhaust gas recirculation conduit, an inner diameter of the narrowed portion of the fresh air intake passage, an angle of convergence between the inner diameter of the fresh air intake passage and the inner diameter of the narrowed portion of the fresh air intake passage, an outer diameter of the exhaust gas recirculation conduit and a depth of insertion of the exhaust gas recirculation conduit, such that flow enhancement from the Coandă effect is obtained.

* * * * *